US008973317B2

(12) United States Patent
Larkin

(10) Patent No.: US 8,973,317 B2
(45) Date of Patent: Mar. 10, 2015

(54) THERMAL BREAK FOR CONCRETE SLAB EDGES AND BALCONIES

(71) Applicant: James Larkin, New York, NY (US)

(72) Inventor: James Larkin, New York, NY (US)

( * ) Notice: Subject to any disclaimer, the term of this patent is extended or adjusted under 35 U.S.C. 154(b) by 0 days.

(21) Appl. No.: 14/273,191

(22) Filed: May 8, 2014

(65) Prior Publication Data

US 2014/0331581 A1 Nov. 13, 2014

Related U.S. Application Data

(60) Provisional application No. 61/822,598, filed on May 13, 2013.

(51) Int. Cl.

| | |
|---|---|
| ***E04C 5/08*** | (2006.01) |
| ***E04B 1/76*** | (2006.01) |
| ***E04B 1/78*** | (2006.01) |
| ***E04C 5/16*** | (2006.01) |

(52) U.S. Cl.

CPC ..... *E04B 1/7608* (2013.01); *E04B 1/78* (2013.01); *E04C 5/16* (2013.01)

USPC ..... 52/223.14

(58) Field of Classification Search

USPC ..... 52/223.14, 223.6, 223.7, 414, 415, 319

See application file for complete search history.

(56) References Cited

U.S. PATENT DOCUMENTS

| | | | | |
|---|---|---|---|---|
| 3,555,753 | A | 1/1971 | Magadini | |
| 4,959,940 | A | 10/1990 | Witschi | |
| 5,799,457 | A | 9/1998 | Schumacher et al. | |
| 5,822,938 | A | 10/1998 | Bahr et al. | |
| 6,082,063 | A * | 7/2000 | Shrive et al. | 52/223.13 |
| 6,308,478 | B1 * | 10/2001 | Kintscher et al. | 52/223.7 |
| 7,051,807 | B2 * | 5/2006 | Vinegar et al. | 166/245 |
| 7,823,352 | B2 | 11/2010 | Fritschi | |
| 8,733,052 | B2 * | 5/2014 | Froehlich | 52/404.4 |
| 2001/0023568 | A1 * | 9/2001 | Edwards et al. | 52/649.1 |
| 2003/0170093 | A1 * | 9/2003 | Janeway | 411/548 |

* cited by examiner

*Primary Examiner* — Mark Wendell
*Assistant Examiner* — Keith Minter
(74) *Attorney, Agent, or Firm* — Myron Greenspan; Lackenbach Siegel LLP

(57) ABSTRACT

A relatively thin flat panel of thermal insulating material is provided with an array of holes or apertures, each coaxially aligned or coextensive with a reinforcement bar emanating from a concrete slab forming an interior floor within a structure consistent with the design of a structural engineer of record. Rebar couplers (nipples) are arranged within each of the holes or apertures of the insulating panel having axial lengths greater than the thickness of the panel to extend beyond the panel on both sides thereof. The couplers are threaded both internally and externally. Nuts or threaded washers are threaded and tightened on both sides of each coupler to secure the coupler in place in relation to the panel. Alternatively, fiberglass rebars can be used extending through the insulating panel.

17 Claims, 7 Drawing Sheets

THERMAL BREAK FOR CONCRETE SLAB EDGES AND BALCONIES

BACKGROUND OF THE INVENTION

1. Field of the Invention

The invention generally relates to construction techniques for slab edges and balconies and, more specifically, to thermal breaks for the same.

2. Description of the Prior Art

A detail that has been problematic in the construction industry concerns concrete slabs that overhang or extend beyond exterior walls of buildings, such as used for balconies, which extensions are exposed but are not thermally insulated from the main structure so that heat can propagate into or out of a building through the concrete slabs. Accordingly, these slabs can serve as heat sinks that absorb and enable heat to escape from the interior of a building and radiate it to the outside, especially on cold days. Attempts have been made to address this problem.

U.S. Pat. No. 5,822,938 is for structural elements for thermal insulation and U.S. Pat. No. 7,823,352 is for a construction element for heat insulation. U.S. Pat. No. 5,799,457 is also for a structural element for thermal insulation. This patent discloses a structural element designed to thermally insulate two concrete components. Reinforcing rods extend through the structural element with the rods extending within each member along either side of an insulating body. The rods run diagonally through the insulating body and extend along the upper and lower edges of the insulating body.

U.S. Pat. No. 3,555,753 discloses a concrete slab joint construction that also makes use of diagonally extending or running rods to provide additional strength or support.

U.S. Pat. No. 4,959,940 discloses a cantilever plate connecting assembly. This patent describes a plate assembly of an insulating body with reinforcing bars extending through it. The reinforcing bars are embedded on one side of the insulation body and, on another side, to a ceiling plate. On both sides of the insulating body there are provided plates made of stainless steel that have pressure reinforcement bars extending through it. The reinforcing bars appear to continually extend through the insulating body. This requires handling and interfacing long lengths of rebars with thermal barriers, rendering the structure and methods less convenient, time consuming to install and thus more costly to implement.

SUMMARY OF THE INVENTION

Accordingly, it is an object of the invention to provide a thermal break construction for concrete edges and balconies.

It is another object of the invention to provide a thermal break construction as in the previous object that is simple in construction and economical to manufacture.

It is still another object of the invention to provide a thermal break of a type under discussion that is easy and quick to install.

It is yet another object of the invention to provide a thermal break for concrete slab edges and balconies of the type under discussion that effectively and significantly reduces heat loss between ambient outside conditions through slab edges and balconies and the inside of a structure.

It is a further object of the invention to provide a thermal break for concrete slab edges and balconies that is compatible with construction or building codes in the United States as well as those of other countries.

It is still a further object of the invention to provide a thermal break as above suggested that is flexible in its use and can be adapted to almost any constructions.

It is yet a further object of the invention to provide a thermal break that is easy to customize and install at construction sites.

It is an additional object of the invention to provide a thermal break as in the previous objects that effectively provides thermal break in concrete slabs while being essentially transparent to the structural forces in a construction and is effective in continuing to transmit compression and tension forces in the concrete reinforcement bars ("rebars").

In order to achieve the above objects, as well as others that will become evident here and after, one embodiment of the present invention uses a relatively thin flat panel of thermal insulating material provided with an array of holes or apertures, each coaxially aligned or coextensive with a reinforcement bar emanating from a concrete slab forming an interior floor within a structure. Nipples are arranged within each of the holes or apertures of the insulating panel having axial lengths greater than the thickness of the panel to extend beyond the panel on both sides thereof. The nipples are threaded both internally and externally. Nuts or threaded washers are threaded and tightened on both sides of each nipple to secure the nipple in place in relation to the panel. Rebars extending from the floor interior structure are aligned with and threaded through each nipple on one side of the panel and rebars that extend beyond the walls to form slab edges or balconies are also threaded and threadedly meshed or engaged with the internal threads on the other side of the panel that faces the exterior of the building structure. The internal threads on each side of the nipple and the external threads on the rebars have sufficient longitudinal or axial lengths to ensure positive and reliable connections between the rebars and each nipple end. Once the rebars have been secured to the nipples on both sides of the thermal-resistant plate the concrete is poured and a thermal break is created that only allows heat to escape through the rebars and nipples but not through the bulk of the poured concrete slabs.

The solution is intended not only to reinforce the slabs and maintain their integrity but to do so by providing a thermal break that prevents heat from flowing from the interior of the structure to the exterior thereby avoiding energy losses. The thermal break, therefore, preserves energy and avoids using excess oil or other heating fuels to render the structure, at least in this respect, more "green".

The thermal break panel may be solid or hollow with an interior that can be void and filled with air to serve as a thermal barrier or can be filled with a thermally insulating material. Extending through two spaced stainless steel plates, for example, internal spacers or couplings that have openings at each end that are internally threaded and suitable for receiving the externally threaded rebars ends.

According to another embodiment a square edge panel of closed cell insulation foam board is substantially enclosed by metal sheet that cover at least the major opposing surfaces of the panel. Fiberglass reinforcing rods extend through the panel and metal sheets to form a thermal break module.

BRIEF DESCRIPTION OF THE DRAWINGS

Those skilled in the art will appreciate the improvements and advantages that derive from the present invention upon reading the following detailed description, claims, and drawings, in which:

DESCRIPTION OF PREFERRED EMBODIMENTS

Figure 1:
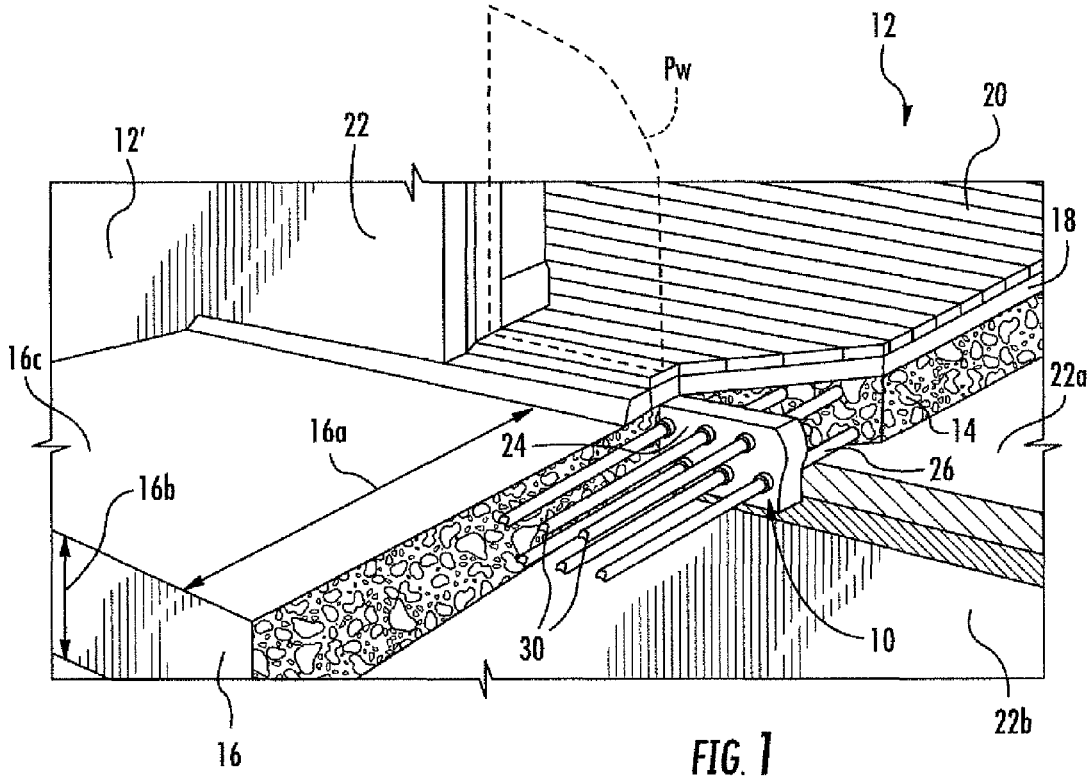
FIG. 1 is a perspective view of a building construction, partially in cross-section, showing a slab edge or balcony formed of poured concrete arranged exteriorly of a poured concrete floor slab interiorly of the construction, illustrating the manner in which the thermal break in accordance with the invention is arranged and cooperates with the rebars for the slabs on both sides of the wall.

Turning now to the Figures, in which identical or similar parts are designated by the same reference numerals throughout, and first referring to FIG. 1, a thermal break construction for concrete slab edges and balconies in accordance with the present invention is generally designated by reference numeral 10.

The thermal break 10 shown in FIG. 1 is used in a construction and, specifically, in a building 12' having an interior space above a floor concrete slab 14 and an exteriorly projecting concrete slab edge or balcony 16. A subfloor 18 is shown above the concrete slab 14 that may be of any suitable material such as plywood or the like. Any conventional floor finishing product 20, such as hardwood planks (shown), tiles, etc., may be applied above the subfloor 18.

The concrete floor slab 14 is generally separated from the slab edge or balcony 16 at a building line generally formed at an exterior wall 22 and represented by a wall plane $P_w$.

The slab edge or balcony 16 projects outwardly a distance 16*a* and has a thickness 16*b*. A top surface 16*c* of the balcony may be left as an unfinished concrete surface or may be finished in any suitable or desired manner. Clearly, the further the slab edge or balcony 16 projects a distance 16*a* away from the plane of the wall $P_w$, and the greater the thickness 16*b* of the slab edge or balcony, the greater the weight of the slab and the greater will be the compression and tension forces on the rebars within the slab edge or balcony 16.

An important feature of the invention is to provide a thermal break 10 that appears transparent to and transmits the tension and compression forces while providing an effective thermal barrier. The interior rebars 26 in FIG. 1 are arranged interiorly of the wall plane $P_w$ while the exterior rebars 30 project to the other side of the plane $P_w$ as shown.

Figure 3:
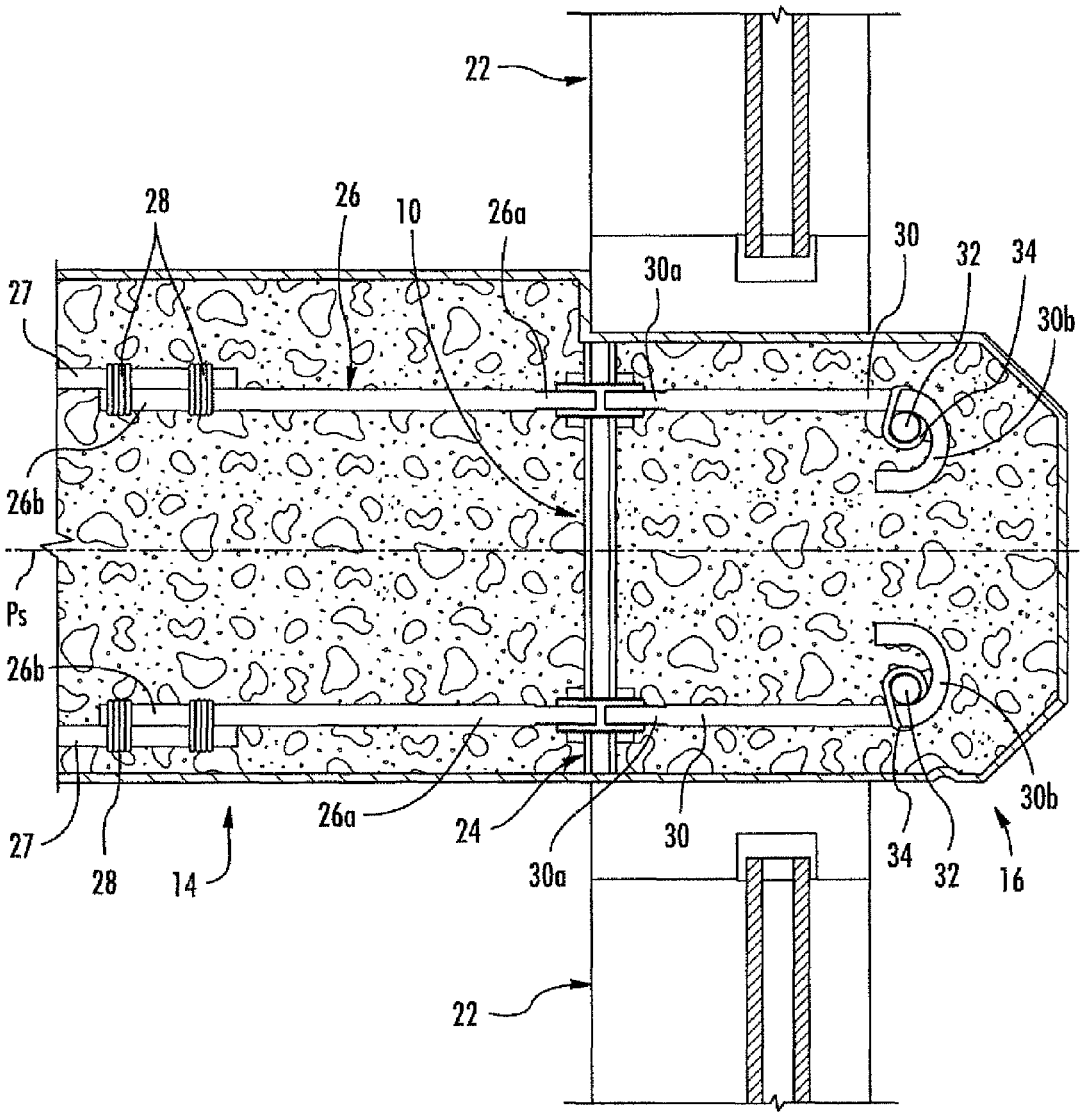
FIG. 3 is an enlarged sectional view of the thermal break panel shown in FIG. 1 and concrete slabs with which it cooperates.

Referring also to FIG. 3, the interior rebars 26 are preferably formed by connecting short and long rebar sections 26 and 27, respectively, as shown that are secured to each other by means of rebar wires 28. The short rebars 26 have free ends 26a, 26b as shown, the free end 26*a* being externally threaded for reasons to be discussed. Since the rebars 27 can have substantial lengths short sections 26 are preferably used to initially secure rebars to the thermal break 10, as to be described. This makes it easier to interface and connect the interior rebars 26 and avoids the need to rotate long lengths of rebars 27.

In FIG. 3, the exterior rebars 30 are provided with inner ends 30*a* and the outer ends 30*b* shown to be curved to semi-circular shapes for engagement with transverse rebars 32, with these being tied and secured to each other by means rebar wires 34. The manner in which the rebars are otherwise arranged to secure to each other to form a grid is not an important feature of the invention. Any conventional methods for aligning the rebars and interconnecting them to each other to form a grid prior to the pouring of the concrete is conventional and are well known to these skilled in the art.

Figure 2:
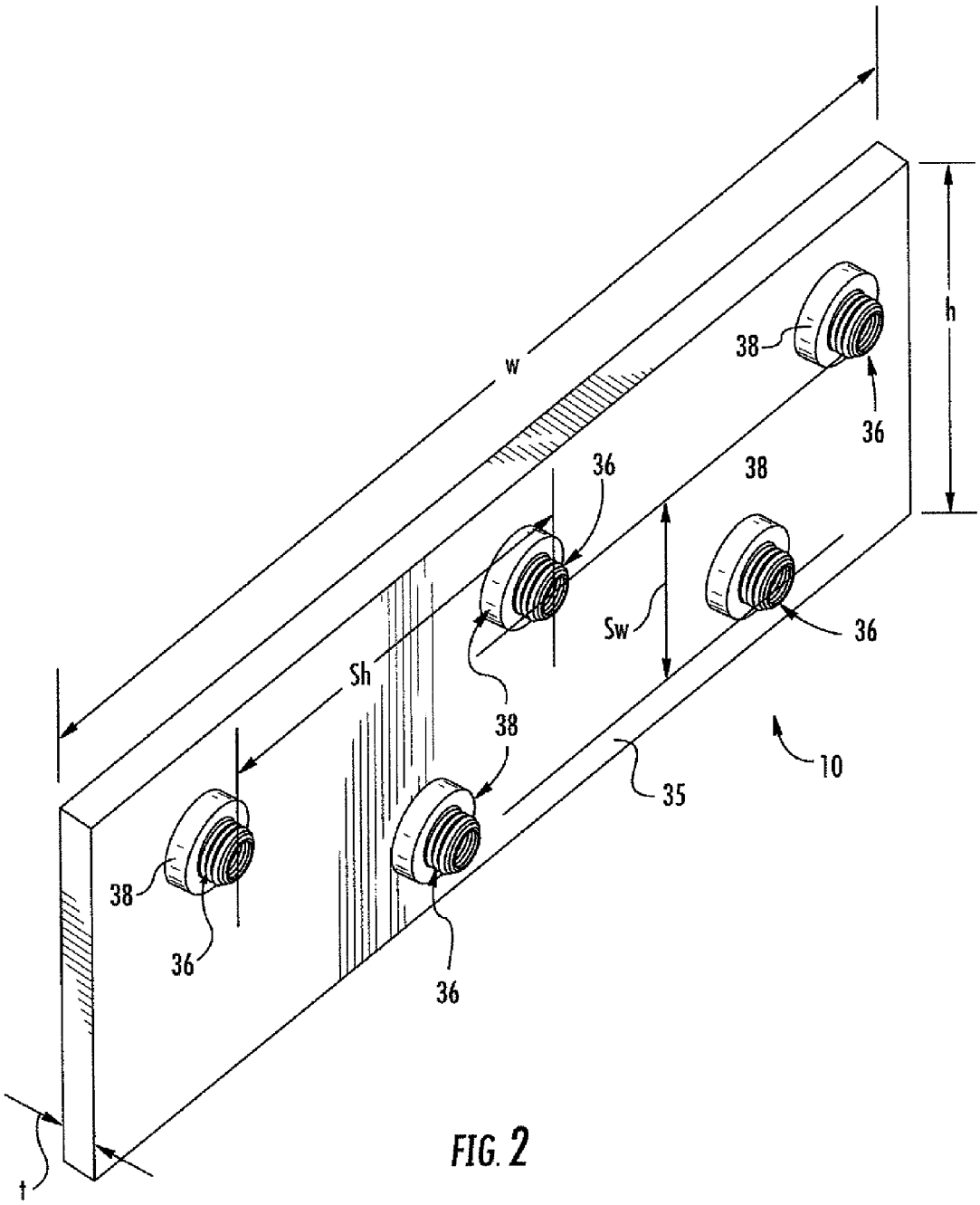
FIG. 2 is a perspective view of the thermal break panel shown in FIG. 1 prepared and ready for use at a construction site for interconnection with rebars used in the construction prior to pouring of the concrete to embed the rebars.

Referring to FIG. 2 a thermal break 10 is shown that includes a flat plate or panel 35 that has a thickness t, a width w and a height h. The thermal break panel 35 includes an array of threaded holes or apertures 35' (FIG. 4), shown as being round, spaced and positioned relative to each other to correspond to the spacial arrangement or configuration of the interior rebars 26 so that the interior rebars register and are coaxially aligned with the holes or apertures 35' in the plate 35. Because long lengths of rebars may be difficult to manipulate, the present invention lends itself to adopting or accommodating the arrangements of rebars 27 that are already in place and formed into a grid on the interior of the building structure. Thus, the panel 35 may either be re-formed with holes so that the rebars are aligned to be coextensive with the holes 35' or the holes can be drilled at the site to match or correspond to the positions of the rebars 27. Either way, the thermal break panel 35 will have a width w to accommodate all of the rebars 27 that need to be extended into the slab edge or balcony on the other side of the wall 22. In FIG. 2, the horizontally adjacent holes within a row are spaced a distance $S_h$ on centers while the holes are vertically spaced on centers between adjacent vertically spaced rows a distance $S_v$. The height h of the thermal break panel 35 will typically correspond to the height of the concrete slabs 14, 16 on both sides of the wall 22.

It will be appreciated that by utilizing relatively short lengths of rebars on both sides of the thermal break 10 this will facilitate their connections to the thermal break plate or panel 35 at one of the ends 26*a*, 30*a* of the rebars while the other ends 26*b*, 30*b*can be secured in conventional ways to either continuing longitudinal rebars 27, transverse rebars 32, etc., as suggested in FIG. 3.

Figure 4:
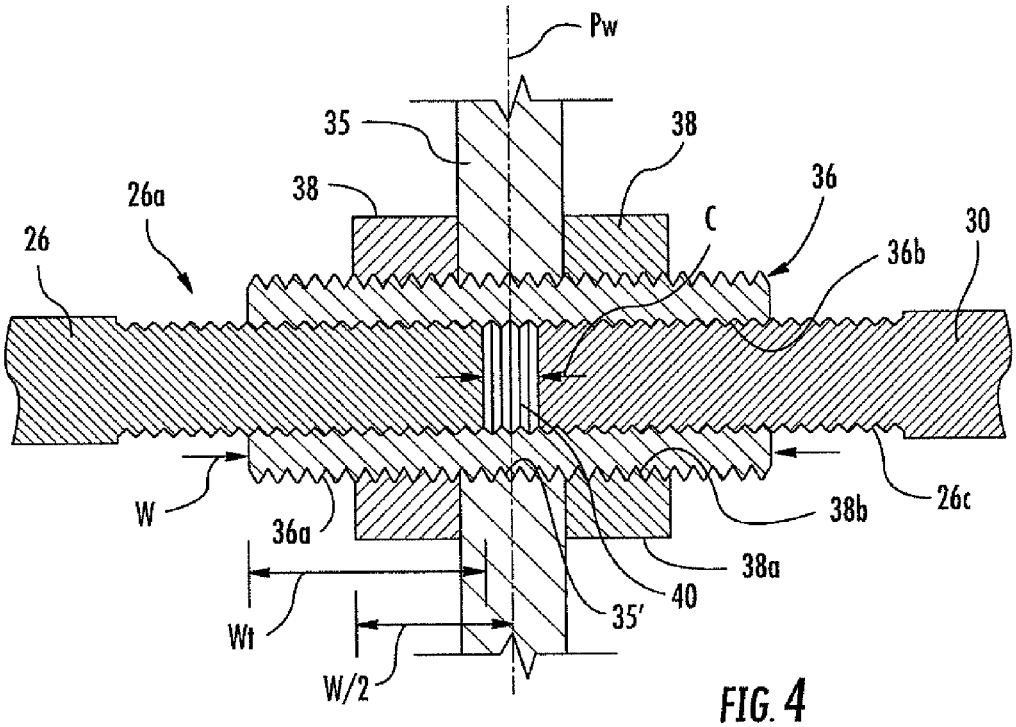
FIG. 4 is an enlarged longitudinal or axial cross-sectional view of the thermal break shown in FIGS. 1-3 and shows the manner in which the interior and exterior rebars interconnected to provide both a thermal break or barrier as well as provide continuity for tension and compression forces to which the rebars are subjected.

Referring to FIG. 4, details are shown of the thermal break plate or panel 35 and the manner in which it is interconnected with the interior rebars 26 and the exterior rebars 30 extending to both sides of the wall plane $P_w$. An important feature of the invention is the provision of nipples 36 provided for each of the holes or apertures 35' within the thermal break plate or panel 35. In FIG. 4, the holes or apertures 35' are internally threaded for threadedly receiving the external threads 36a on the nipple 36. However, it is also possible to use a simple non-threaded hole or aperture that is oversized to receive, with small clearance, the nipple 36. The nipple 36 is preferably arranged in relation to the plate 10 so that the free ends thereof project equidistantly to each side of the plane $P_w$, or the wall 22. The nipple 36 is secured to the plate or panel 35 by means of nuts or threaded rings or other suitable fasteners 38.

The nipples 36 are provided with both external threads 36*a* as well as internal threads 36*b*. The threaded rings or nuts 38 are meshed with the external threads 36*a* on the nipples until there is a press fit between the fasteners 38 and the plate or panel 35. When both nuts or threaded rings 38 are tightened on the nipple 36 against the thermal break plate 35, this secures the nipple 36 in place in relation to the plate and prevents it from moving axially in relation thereto. The cooperating rebars 26 are threaded at the free ends 26*a* with a complementary thread to the internal threads 36*b* on the nipple 36 so that the free ends 26*a* can be engaged with the nipple as shown. Similarly, the exterior or external rebar 30 is provided with an exterior thread so that it can be screwed in and engaged with the nipple 36 on the other side of the wall.

Figure 5:
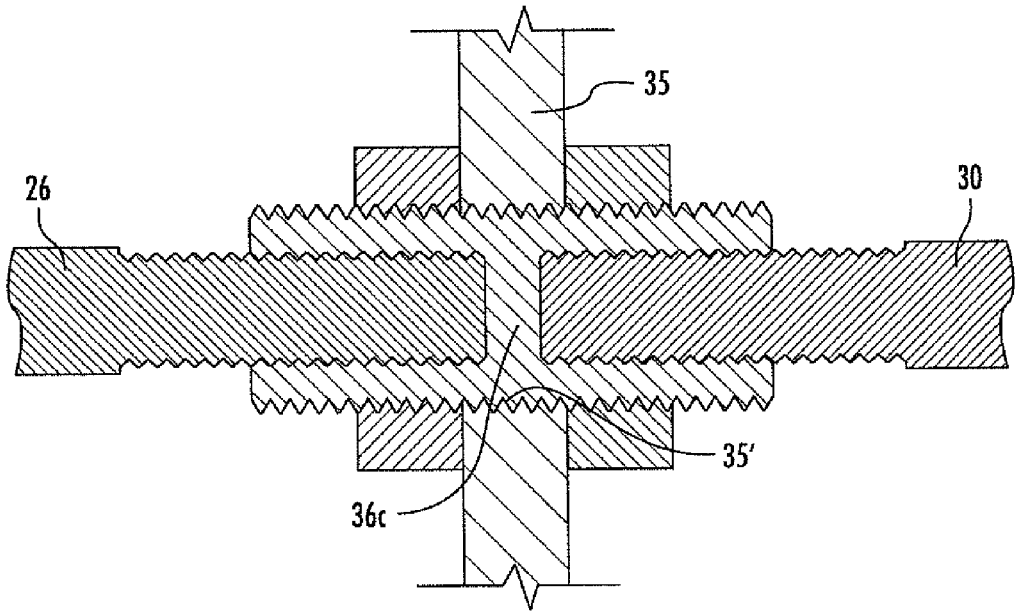
FIG. 5 is similar to FIG. 4, but showing a different embodiment of the nipple forming part of the thermal break construction.

Different means can be adapted for controlling the extent of entry or engagement between the rebar ends 26*a*, 30*a* and the nipple such that they are both substantially equally engaged with an equal or substantially equal number of threads to ensure that the rebar is equally strong and secure on both sides of the thermal break panel 35. In FIG. 4, a predetermined length $w_t$ is advanced into the nipple 36 to leave a space 40 defining a clearance C shown in FIG. 4. As long as substantially equal lengths of rebar are advanced and engaged at the both ends of the nipple 36, the nipple will provide adequate strength and support to reliably transmit compression and tension forces between the interior and exterior rebars. In FIG. 5, an alternative embodiment of the nipple is shown in which a partition wall or wall portion 36*c* is provide midway along the axial length of the nipple 36. This construction allows both rebars on both sides of the nipple to be fully threaded inwardly, the wall portion 36*c* acting as a stop to ensure that equal lengths of the rebar have been received and the maximum required lengths of rebar are utilized. With the embodiment shown in FIG. 4 it is possible that one rebar is advanced more than the other since there is no positive stop to inform a user when adequate axial length of rebar has been received within the nipple. A further approach is to limit the number of threads on the rebar ends with the embodiment shown in FIG. 4 that enable only a predetermined threaded axial length of the rebar to be screwed into the nipple, the threads on the rebar ends serving as stops to ensure equal entry.

Figure 6:
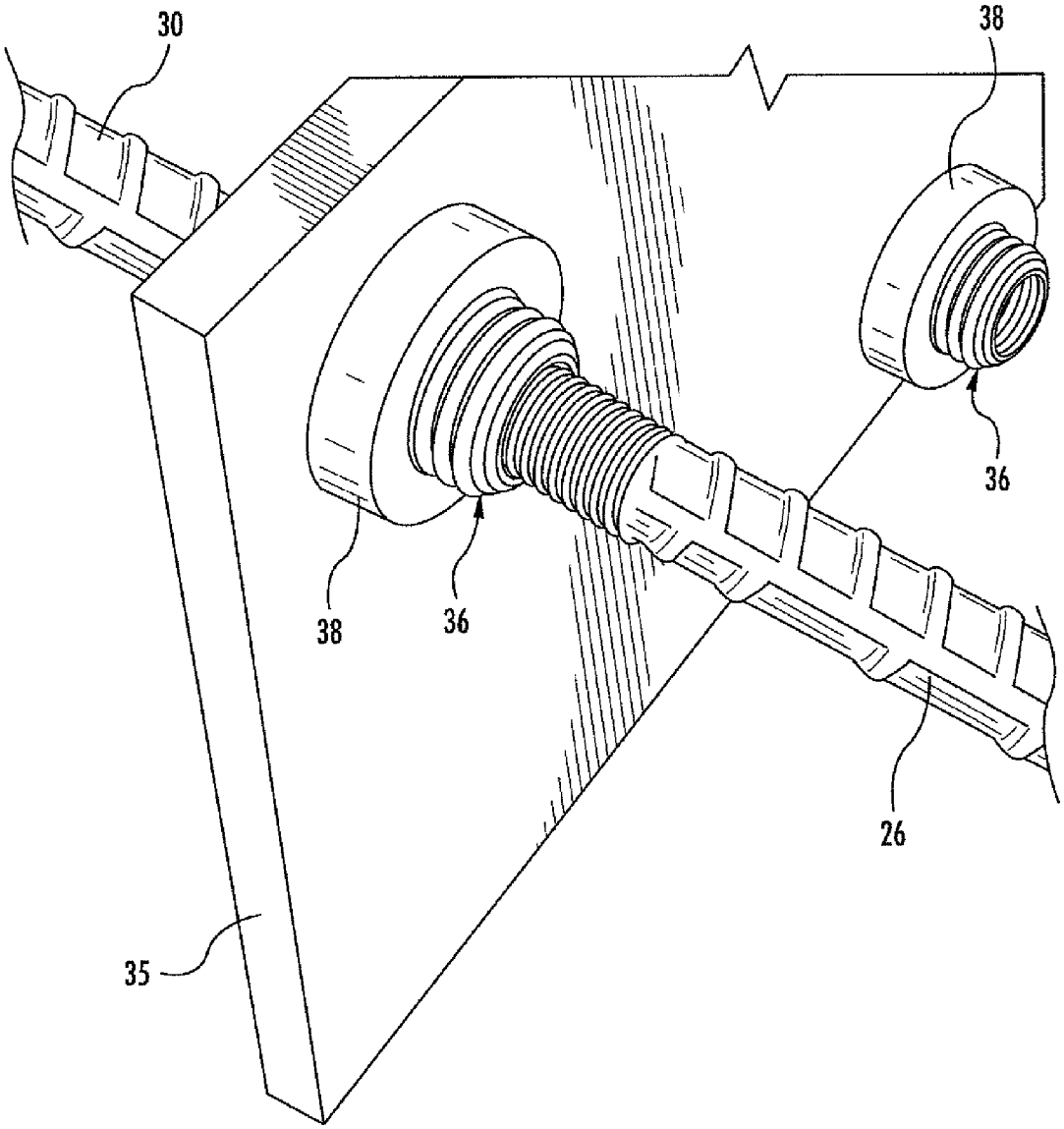
FIG. 6 is a perspective view of the thermal break panel shown in FIG. 1 showing an enlarged view of one nipple and the connection thereof to a rebar.
Figure 7:
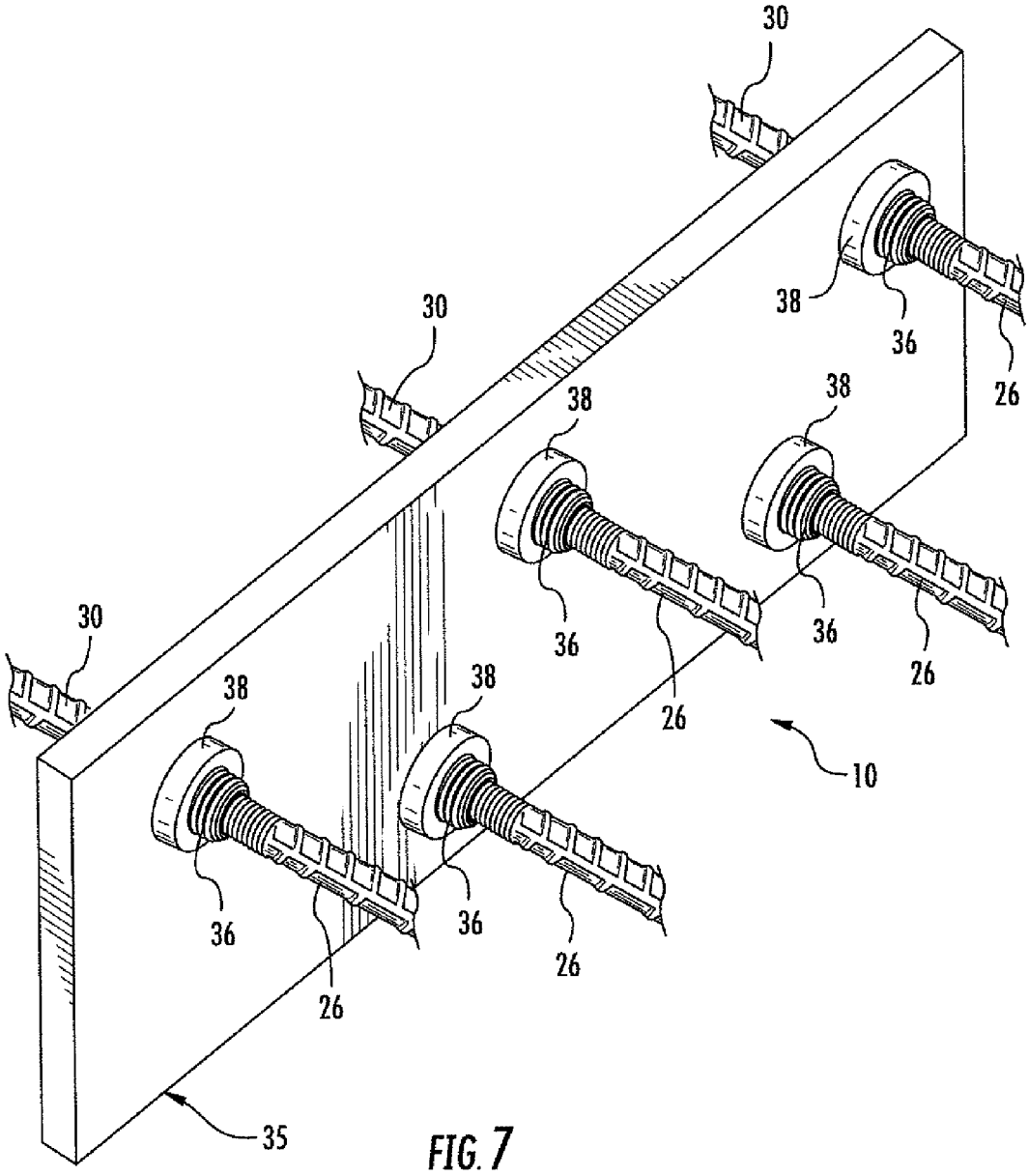
FIG. 7 is similar to FIG. 6 but shows a plurality of rebars connected to each other through the thermal break panel once fully assembled and ready for concrete to be poured.

Referring to FIGS. 6 and 7, the assembly step is illustrated in FIG. 6 as the internal rebar 26 is threadedly meshed into the nipple 36 after it has been secured in place by the threaded ring 38. In FIG. 7, all the rebar ends are shown engaged with their respective nipples and the thermal break plate 35 ready to be poured over by the concrete to form the slabs.

It should be clear that the sizes of the holes 35' formed in the thermal break panel may vary to accommodate different steel rebar sizes, standard rebars having nominal diameters typically ranging from 0.375 inches to 2.275 inches. The present invention can be used in any constructions that use steel, black, epoxy coated or fabricated rebars.

Since standard rebars stand at lengths of 20 feet, 30 feet and 60 feet, these are sometimes difficult to handle and, particularly, to rotate them in order to threadedly mesh them with nipples in accordance with the invention. It is preferable, therefore, to segment the rebars at a location proximate to the thermal break plate 35, as shown in FIG. 3, so that the short sections 26 ends 26*a*can be easily rotated to provide the desired threaded meshing and the other free ends 26*a*then connected to a long length of rebar 27 as discussed.

In order to provide an effective thermal break, the panel 35 needs to be made from an insulating material and any suitable material may be used for this purpose. However, an example of a material that is suitable for this purpose, is a laminate sold by Accurate Plastics, Inc. under the trademark ACCULAM®. This is a laminate is formed as a panel of a flame resistant epoxy resin and woven fiberglass substrate. This material has high mechanical strength and excellent insulating qualities. Specifically, ACCULAM® EPDXY GLAS G10 is glass coat using epoxy resin binders. Its thermal conductivity is $7.0\times10^4$ calaries/second/$cm^2$/° c./cm. Other industrial laminates having the desired properties using phenolic, melomin, silicone and polyester resin binders can also be used with different degrees of advantage.

The thermal break plate 35 in accordance with the invention reduces heat loss in structures that utilize slab edges and balconies and may qualify for government tax credits as being "green" components. Thermal breaks in accordance with the invention are fire proof, thermally insulating, resistant corrosion and effectively support exterior concrete slabs. In order to enhance the anti-corrosive properties of the thermal break 10 and its implementation, high strength corrosion resistant steels are preferably used, especially for the short lengths 26, 30 that interface with the thermal break panel 35. One reinforcing bar that it is particularly useful with the invention are $MMFX_2$ reinforcing bars. These are also available in a number of sizes ranging from rebar sizes 10-57 (#3-18) that range in diameter from 0.375 to 2.270 in ($MMFX_2$). Information on this product can be found at http://www.mmfx.com.

While rebar wires 28, 34 have been shown as tie wires for securing cooperating rebars to form the desired rebar lattice or grid, it would be evident to those skilled in the art that any components for attaching the free ends of the rebars can be used. For example, a number of different splicing devices and systems manufactured by Barsplice Product, Inc. can be used This company produces flanged couplers, position couplers as well inert plastic plug devices. The specific manner in which the rebar ends are secured to each other do not form an important part of the present invention and any such known techniques may be used.

In view of the above, it would be clear to those skilled in the art that the thermal break panel 10 in accordance with the present invention is easy to assemble and install. Using high strength steel can also obviate the need for the use of different size rebars so that fewer, or even one, size rebar and nipple can be used and stocked. This substantially facilitates the use of rebars in the field and construction sites in which one rebar size essentially can fit all applications where slab edges and balconies are used. By using strong epoxy glass laminate sheets, for example, appropriate panels can be cut to desired sizes and drilled at the site so that, again, assembly can be expedited and inventory requirements reduced.

The stainless steel selected is sufficiently strong and corrosion resistant so that one size or set of components can be used for any anticipated structures and support any anticipated loads. This helps with maintaining inventories and simplifying applications.

Figure 8:
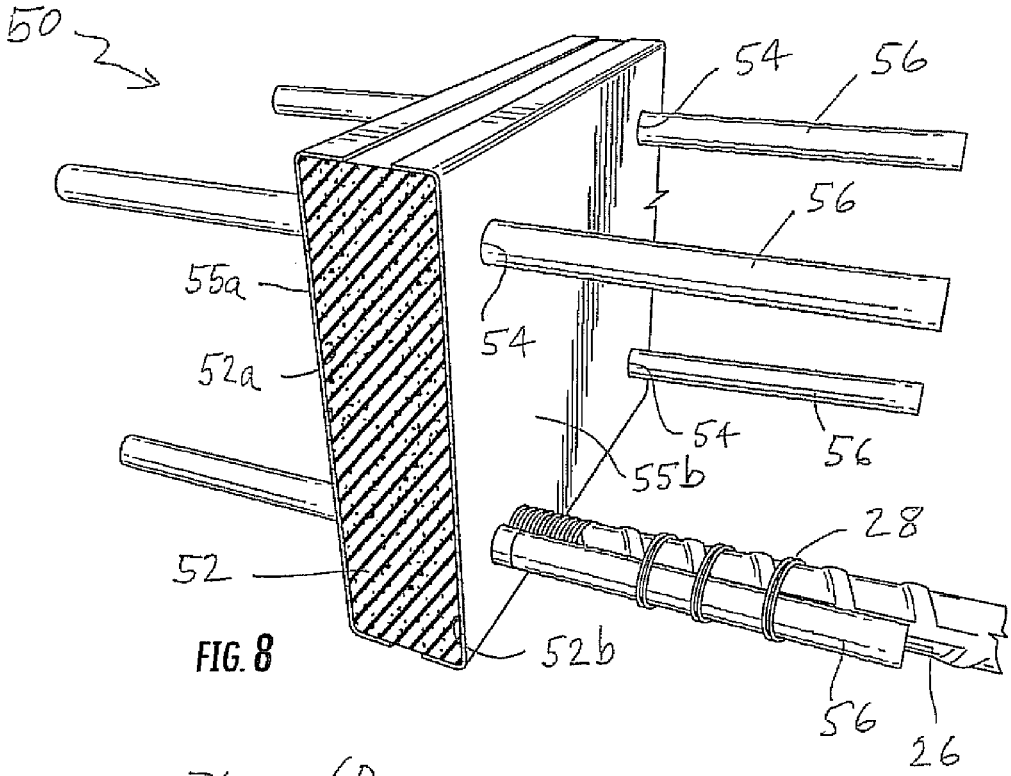
FIG. 8 is a perspective view of another embodiment of the invention partially tied to an external reinforcing bar.
Figure 9:
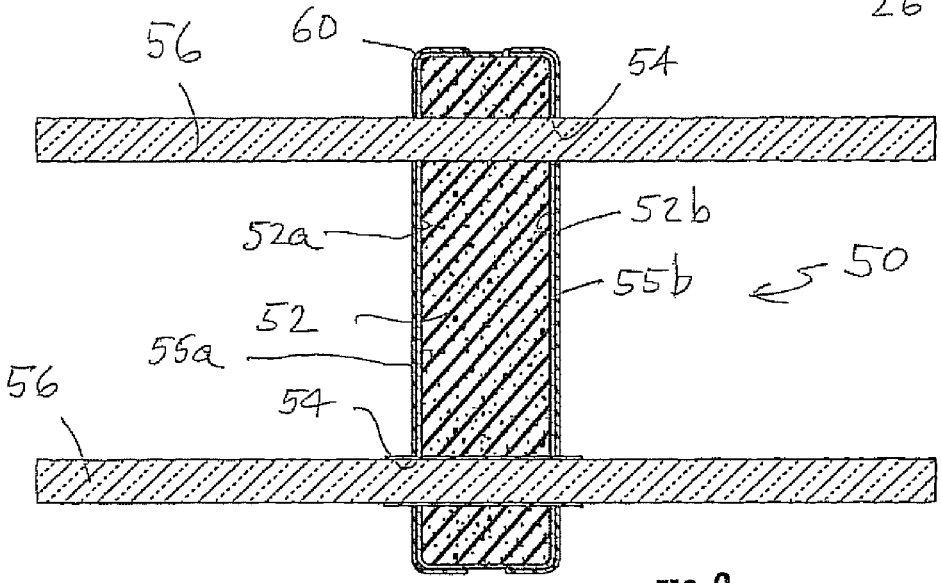
FIG. 9 is a cross-section taken through a central plane in FIG. 8.

In accordance with another embodiment of the invention, a simpler and yet more effective construction is illustrated in FIGS. 8 and 9 and designated by the reference numeral 50. The assembly or module 50 can be either preassembled or assembled in the field prior to integration with the reinforcement system in a structure.

The module 50, once assembled, includes a foam insulation board 52. The insulation board 52 may be in the nature of an extruded polystyrene foam square edge insulation panel. Such panel is marketed under the brand STYROFOAM™ and is available from Dow Building Solutions, a Division of the Dow Chemical Company located in Midland, Mich. 48674. Additional information about this product can be found at www.buildingsolutions.com The extruded panel is provided with square edges on four sides to ensure energy efficiency and to minimize on-site cutting and waste. Being a closed cell structure, it offers superior water resistance. Importantly, however, its low thermal resistance is suitable for the intended use, having a thermal resistance per inch and R-values of 5.0-5.6 at temperatures ranging from 25° F.-75° F. The insulation board 52 is easy to handle and can be easily cut in the field using a utility knife or serrated blade if needed to modify the size or shape of the module. The foam insulation board 52 defines two spaced opposing parallel major surfaces 52*a*, 52*b* that are normally arranged when installed in vertical planes as suggested in FIGS. 8 and 9.

In forming the module 50 transverse holes 54 are formed in the insulation board 52. The diameters of the holes 54 are selected to correspond to the outer diameters of reinforcing bars 56 that extend through the foam insulation board 52 and project distances to both sides of the module lengths that are adequate for tying to exterior reinforcement bars in a conventional manner as suggested in FIG. 3. An important feature of the present invention is that the reinforcement bar 56 are fiberglass reinforcement bars that have excellent thermal insulation properties. A fiberglass reinforcing bar that can be used is marketed under the brand V-Rod™ distributed by RJD Industries, Inc., of Laguna Hills, Calif. 92653 and additional information about V-Rod™ fiberglass reinforcement rods can be found at www.rjdindustries.com and www.pultrall.com of Pultrall of Quebec, CA. This product is highly efficient in resisting heat transfer.

Referring to FIG. 9, optional tape or sealer 58 may be applied between the reinforcing bars 56 and the foam insulation board 52 to prevent initial slippage or movement therebetween, after the reinforcing bars have been set, during the further use of the module 50.

The insulation board 52 is preferably clad, at least at its major surfaces 52*a*, 52*b* with metal panels 55*a*, 55*b* that cover at least the major surfaces. In a presently preferred embodiment, the protective panels 55*a*, 55*b* extend above and over at least portions of the upper and lower surfaces of the foam board. The panels 55*a*, 55*b* can be made from many strong sheet material to protect the foam board. In the presently preferred embodiment, these panels are made of 20 gage electro-galvanized sheets may be used for this purpose. However, any other suitable material may be used for this purpose.

In accordance with the presently preferred embodiment, the entire module, including the foam board 52 and panels are coated and the fiberglass reinforcing bars 56 are at least partially coated to fully encapsulate the foam board and the panels 55*a*, 55*b*. Only those portions of the reinforcing bars 56 proximate to the foam board need be covered by a suitable coating material.

In accordance with the presently preferred embodiment, the module 50 is coated with a fire resistant spray coating 60. One example of a suitable coating is marketed by the Building Safety Solutions Depai tnient of the 3M Company in St. Paul, Minn. 55144. This spray coating is marketed under the brand "FIRE DAM" Spray 200 and dries to form a tough, elastomeric protective coating. The coating 60 protects the module from environmental conditions as well as controls the transmission of fire, heat during and after exposure to fire. Additional information about the coating 60 is available at www.3M.com.firestop.

Once the module 50 has been assembled and preferably coated as described it can be integrated into the construction as described in connection with FIGS. 1-7. It has been found that the module 50 has superior thermal insulation properties and, therefore, serves as an excellent thermal break in constructions where it is used.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A thermal break for use in construction comprising a panel formed of insulation material having a thermal resistance and defining opposing spaced parallel major surfaces; reinforcing bar sections extending in opposite directions from each of said major surfaces and having lengths suitable for being tied to a reinforcement grid of external reinforcement bars, each reinforcing bar section extending from one major surface being associated with a reinforcing bar section extending from the other opposing major surface for transmitting tension forces, associated reinforcing bar sections including thermal insulation means for providing thermal resistance between each two associated reinforcing bar sections, whereby a module is formed for providing thermal resistance both through said panel and through said reinforcing bar sections for reducing flow of heat through said reinforcing bar sections from one side of said module to the other.

2. A thermal break as defined in claim 1, wherein said panel comprises a foam insulation panel.

3. A thermal break as defined in claim 2, wherein said foam panel is made of closed cell foam.

4. A thermal break as defined in claim 2, wherein said foam panel is formed of polystyrene foam.

5. A thermal break as defined in claim 1, wherein said thermal insulation means comprises an insulating section of rod, and each pair of associated reinforcing bar sections on opposite sides of said panel are integrally formed with said section of rod.

6. A thermal break as defined in claim 5, wherein said reinforcing bar sections and section of rod form a continuous integral reinforcement bar extending through said panel.

7. A. thermal break as defined in claim 6 wherein said reinforcement bar is formed of fiberglass.

8. A thermal break as defined in claim 1, further comprising a protective sheet substantially covering said panel.

9. A thermal break as defined in claim 8, wherein said protective sheet is formed of metal sheets covering at least said major surfaces.

10. A thermal break as defined in claim 9, wherein said metal sheets are formed of electro-galvanized sheets.

11. A thermal break as defined in claim 10, wherein said sheets are 20 gage.

12. A thermal break as defined in claim 8, further comprising a protective coating fully covering and encapsulating said panel, protective sheet and at least portions of said reinforcing bar sections proximate to said panel.

13. A thermal break as defined in claim 12, wherein said protective coating is fire retardant.

14. A thermal break as defined in claim 1, wherein said panel is formed of epoxy resin.

15. A thermal break as defined in claim 14, wherein said epoxy resin incorporates woven fiberglass.

16. A thermal break as defined in claim 1, wherein said panel includes an insulating layer of air between said major surfaces.

17. A thermal break for use in construction comprising a panel formed of insulation material having a high thermal resistance and defining opposing spaced parallel major surfaces: reinforcing bar sections extending in opposite directions from each of said major surfaces and having lengths suitable for being tied to a reinforcement grid of external reinforcement bars, each reinforcing bar section extending from one major surface being associated with a reinforcing bar section extending from the other opposing major surface for transmitting tension forces: and thermal insulation means within said panel for providing thermal resistance between each two associated reinforcing bar sections, whereby a module is formed for enhancing thermal resistance both through said panel and through said reinforcing bar sections for reducing flow of heat from one side of said module to the other, wherein said associated reinforcing bar sections have threaded ends and further comprising a plurality of nipples extending through said panel each having opposing threaded ends for mating engagement with the threaded ends of said reinforcing bar sections.

* * * * *